US009195187B2

(12) United States Patent
Kan et al.

(10) Patent No.: US 9,195,187 B2
(45) Date of Patent: Nov. 24, 2015

(54) IMAGE FORMING APPARATUS

(71) Applicant: CANON KABUSHIKI KAISHA, Tokyo (JP)

(72) Inventors: Shogo Kan, Yokohama-shi (JP); Akimichi Suzuki, Yokohama-shi (JP); Satoshi Nishida, Numazu-shi (JP); Hideo Nanataki, Yokohama-shi (JP); Takanori Mitani, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 14/092,734

(22) Filed: Nov. 27, 2013

(65) Prior Publication Data

US 2014/0153950 A1 Jun. 5, 2014

(30) Foreign Application Priority Data

Dec. 3, 2012 (JP) ..... 2012-264443

(51) Int. Cl.
*G03G 15/20* (2006.01)

(52) U.S. Cl.
CPC ..... *G03G 15/2046* (2013.01); *G03G 15/2078* (2013.01)

(58) Field of Classification Search
CPC ..... G03G 15/2078; G03G 15/2039; G03G 15/2046
USPC ..... 399/69
See application file for complete search history.

(56) References Cited

U.S. PATENT DOCUMENTS

| | | | | |
|---|---|---|---|---|
| 2004/0114952 | A1* | 6/2004 | Yamamoto | 399/69 |
| 2009/0196644 | A1* | 8/2009 | Funatsu | 399/69 |
| 2012/0315060 | A1* | 12/2012 | Sugiyama et al. | 399/69 |
| 2013/0287423 | A1* | 10/2013 | Ohba | 399/69 |
| 2014/0133878 | A1* | 5/2014 | Okuzono | 399/69 |

FOREIGN PATENT DOCUMENTS

| | | |
|---|---|---|
| JP | 2006-154413 A | 6/2006 |
| JP | 2012-118496 A | 6/2012 |

* cited by examiner

*Primary Examiner* — Sophia S Chen
(74) *Attorney, Agent, or Firm* — Canon USA, Inc., IP Division

(57) ABSTRACT

An image forming apparatus configured to form a toner image on a recording material, includes: an image forming unit configured to form a unfixed toner image on the recording material; a fixing unit configured to heat the recording material where the unfixed toner image is formed while conveying the recording material using a nip portion, and to fix the unfixed toner image on the recording material; and a control unit configured to perform control so that temperature of the fixing unit is maintained in target temperature, with the target temperature ($T_n$) of a n'th page in consecutive printing being set to the highest temperature of the target temperatures ($T_n$ to $T_{n+k}$) according to each of image densities ($D_n$ to $D_{n+k}$) at (n to (n+k))'th pages, where integer k≤1.

9 Claims, 9 Drawing Sheets

IMAGE FORMING APPARATUS

BACKGROUND OF THE INVENTION

1. Field of the Invention

The present invention relates to an image forming apparatus such as an electrophotography system copying machine, a printer, and so forth.

2. Description of the Related Art

In recent years, with regard to image forming apparatuses such as electrophotography system copying machines, printers, and so forth as well, there has been demand for reduction in power consumption. In particular, of devices to be mounted on image forming apparatuses, a fixing apparatus configured to heat a recording material supporting a toner image and to fix the toner image on the recording material is one of the most power consuming devices, and accordingly, there has been great demand for power reduction demand for fixing apparatuses.

However, in the event that heat quantity lacks at the time of fixing a toner image on a recording material in a fixing apparatus, an image defect such as cold offset or the like may occur. Accordingly, heretofore, even in the event that toner weight per unit area is the maximum, fixation temperature has been uniformly set to the minimum temperature where fixing is enabled, and also, no cold offset occurs. Accordingly, excessive power has been supplied to the fixing apparatus in the event that toner weight per unit is been small, and accordingly, waste of power has occurred.

Therefore, in order to reduce waste of power such as described above, it can be conceived to adjust power to be supplied to a fixing apparatus according to weight per unit area of toner supported on a recording material. In Japanese Patent Laid-Open No. 2006-154413, there has been disclosed an image forming apparatus configured to change heater control temperature according to weight per unit area of unfixed toner. The image forming apparatus according to Japanese Patent Laid-Open No. 2006-154413 can reduce power consumption by predicting weight per unit area of unfixed toner from image data, and correcting heater control temperature.

However, with the image forming apparatus according to Japanese Patent Laid-Open No. 2006-154413, in the event that weight per unit area of toner of recording materials to be consecutively printed changes greatly from page to page, temperature at the nip portion does not follow the weight of toner, and an image defect such as cold offset or the like may occur.

For example, cold offset may occur immediately after printing a recording material of which weight per unit area of toner is small, and in the event of printing a recording material of which weight per unit area of toner is great. This cold offset occurs because temperatures of a film and a pressing roller does not increase up to temperature according to toner weight per unit area of a toner image on a recording material, and this is apparent at a front edge of a recording material. At the time of performing printing in a state in which the target temperature of the heater is low, the temperatures of the film and pressing roller are kept in a low state. Even when suddenly increasing the target temperature of the heater from a state in which the temperatures of the film and pressing roller are low, the temperatures of the film and pressing roller somewhat having heat capacity may not rise with good responsivity.

SUMMARY OF THE INVENTION

In accordance with a first aspect of the present invention, an image forming apparatus configured to form a toner image on a recording material, includes: an image forming unit configured to form a unfixed toner image on the recording material; a fixing unit configured to heat the recording material where the unfixed toner image is formed while conveying the recording material using a nip portion, and to fix the unfixed toner image on the recording material; and a control unit configured to perform control so that temperature of the fixing unit is maintained in target temperature, with the target temperature ($T_n$) of a n'th page in consecutive printing being set to the highest temperature of the target temperatures ($T_n$ to $T_{n+k}$) according to each of image densities ($D_n$ to $D_{n+k}$) at (n to (n+k))'th pages, where integer $k \geq 1$.

In accordance with a second aspect of the present invention, an image forming apparatus configured to form a toner image on a recording material, includes: an image forming unit configured to form a unfixed toner image on the recording material; a fixing unit configured to heat the recording material where the unfixed toner image is formed while conveying the recording material using a nip portion, and to fix the unfixed toner image on the recording material; and a control unit configured to perform control so that temperature of the fixing unit is maintained in target temperature, with the target temperature ($T_n$) of a n'th page in consecutive printing being set to the highest temperature of the target temperature ($T_n$) according to image density $D_n$ at the n'th page, and corrected target temperatures ($T_{n+1}'$ to $T_{n+k}'$) obtained by correcting the target temperatures ($T_{n+1}$ to $T_{n+k}$) according to each of image densities ($D_{n+1}$ to $D_{n+k}$) at ((n+1) to (n+k))'th pages respectively, according to the number of pages from the n page of the pages ((n+1) to (n+k)) respectively, where integer $k \geq 1$.

In accordance with a third aspect of the present invention, an image forming apparatus configured to form a toner image on a recording material, includes: an image forming unit configured to form a unfixed toner image on the recording material; a fixing unit configured to heat the recording material where the unfixed toner image is formed while conveying the recording material using a nip portion, and to fix the unfixed toner image on the recording material; and a control unit configured to perform control so that temperature of the fixing unit is maintained in target temperature, with the target temperature ($T_n$) of a n'th page in consecutive printing being set to lower temperature in a case where the highest image density of each of image densities ($D_n$ to $D_{n+k}$) of (n to (n+k))'th pages respectively is a first image density than a case where the highest image density is a second image density higher than the first image density, where integer $k \geq 1$.

Further features of the present invention will become apparent from the following description of exemplary embodiments with reference to the attached drawings.

DESCRIPTION OF THE EMBODIMENTS

First Embodiment (1) Image Forming Apparatus

Figure 1:
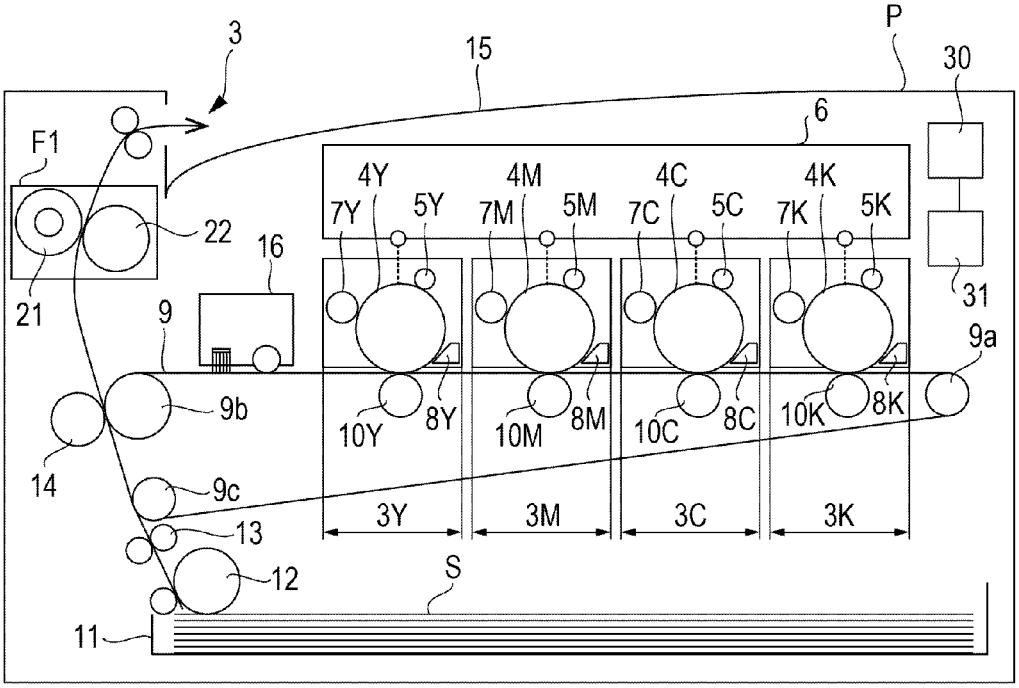
FIG. 1 is a diagram illustrating a configuration of an image forming apparatus according to a first embodiment.

An image forming apparatus according to the present embodiment will be described. FIG. 1 illustrates an image forming apparatus P to be used for the present embodiment. The image forming apparatus P includes a conveying path 3 of a recording material S, and four image forming stations 3Y, 3M, 3C, and 3K arrayed in a generally linear shape in a generally vertical direction to this conveying path 3. Of the four image forming stations 3Y, 3M, 3C, and 3K, the 3Y is an image forming station configured to form a yellow (hereinafter, abbreviated as Y) image. The 3M is an image forming station configured to form a magenta (hereinafter, abbreviated as M) image. The 3C is an image forming station configured to form a cyan (hereinafter, abbreviated as C) image. The 3K is an image forming station configured to form a black (hereinafter, abbreviated as K) image.

The image forming stations 3Y, 3M, 3C, and 3K include drum-type electrophotographic photosensitive members (hereinafter, referred to as photosensitive drums) 4Y, 4M, 4C, and 4K serving as image carrying members, and charging rollers 5Y, 5M, 5C, and 5K serving as charging devices, respectively. Also, the image forming stations 3Y, 3M, 3C, and 3K include an exposure device 6 serving as an exposure device, developing devices 7Y, 7M, 7C, and 7K serving as developing devices, and cleaning devices 8Y, 8M, 8C, and 8K serving as cleaning devices, respectively. A video controller 30 transmits, upon receiving image information from an external device (not illustrated) such as a host computer or the like, a print signal to a control unit 31, and image forming operation is started. At the time of forming an image, the photosensitive drum 4Y is rotated in a predetermined direction at the image forming station 3Y. First, the outer peripheral surface of (surface) of the photosensitive drum 4Y is evenly charged by the charging roller 5Y, and exposed by a laser beam according to image data being irradiated on the charged surface of the photosensitive drum 4Y surface thereof by the exposure device 6, thereby forming an electrostatic latent image. The latent image thereof is visualized by the developing device 7Y using Y toner, and becomes a Y toner image. Thus, the Y toner image is formed on the photosensitive drum 4Y surface. The same image forming process is also performed at the image forming stations 3M, 3C, and 3K. Thus, an M toner image is formed on the photosensitive drum 4M surface, a C toner image is formed on the photosensitive drum 4C surface, and a K toner image is formed on the photosensitive drum 4K surface, respectively.

An endless intermediate transfer belt 9 provided along the array direction of the image forming stations 3Y, 3M, 3C, and 3K is stretched over a driving roller 9*a*, a driven roller 9*b*, and a driven roller 9*c*. The driving roller 9*a* rotates in a predetermined direction, whereby the intermediate transfer belt 9 is rotationally moved along the image forming stations 3Y, 3M, 3C, and 3K at speed of 100 mm/sec. With the outer peripheral surface (surface) of this intermediate transfer belt 9, toner images of the colors are sequentially overlapped-transferred by primary transfer devices 10Y, 10M, 10C, and 10K disposed facing the photosensitive drums 4Y, 4M, 4C, and 4K sandwiching the intermediate transfer belt 9 therebetween, respectively. Thus, full color toner images of the four colors are formed on the intermediate transfer belt 9 surface.

Transfer-residual toner remaining in the photosensitive drums 4Y, 4M, 4C, and 4K surfaces is removed by a cleaning blade (not illustrated) provided to the cleaning devices 8Y, 8M, 8C, and 8K after primary transfer. Thus, the photosensitive drums 4Y, 4M, 4C, and 4K prepare for the next image formation.

On the other hand, the recording material S stacked and stored in a feeding cassette 11 provided to the lower portion of the image forming apparatus P is separated and fed from the feeding cassette 11 by a feeding roller 12 one page at a time, and fed to a registration roller pair 13. The registration roller pair 13 feeds the fed recording material S to a transfer nip portion between the intermediate transfer belt 9 and a secondary transfer roller 14. The secondary transfer roller 14 is disposed so as to face the driven roller 9*b* sandwiching the intermediate transfer belt 9 therebetween. Bias is applied to the secondary transfer roller 14 from a high-voltage power source (not illustrated) when the recording material S passes through the transfer nip portion. Thus, the full color toner image is secondary-transferred to the recording material S from the intermediate transfer belt 9 surface passing through the transfer nip portion. A configuration described above wherein a toner image is formed on a recording material is taken as an image forming unit.

The recording material S on which the toner image is formed is conveyed to a fixing apparatus F1 serving as a fixing unit. The recording material S thereof is heated and pressed by passing through the fixing apparatus F1, and the toner image thereof is heated and fixed on the recording material S. The recording material S thereof is discharged from the fixing apparatus F1 to a discharge tray 15 outside an image forming apparatus (printer) P.

Transfer-residual toner remaining on the intermediate transfer belt 9 surface is removed by an intermediate transfer belt cleaning device 16 after secondary transfer. Thus, the intermediate transfer belt 9 prepares for the next image formation.

(2) Fixing Apparatus

The fixing apparatus (fixing unit) of the image forming apparatus will be described. With the following description, regarding the fixing apparatus and members making up the fixing apparatus, "longitudinal direction" is a direction orthogonal to a recording material conveying direction in a surface parallel to the surface of a recoding material, and "transverse direction" is a recording material conveying direction. "width" is the dimension of the transverse direction. Regarding a recoding material, "longitudinal width" is the dimension of the longitudinal direction.

Figure 2:
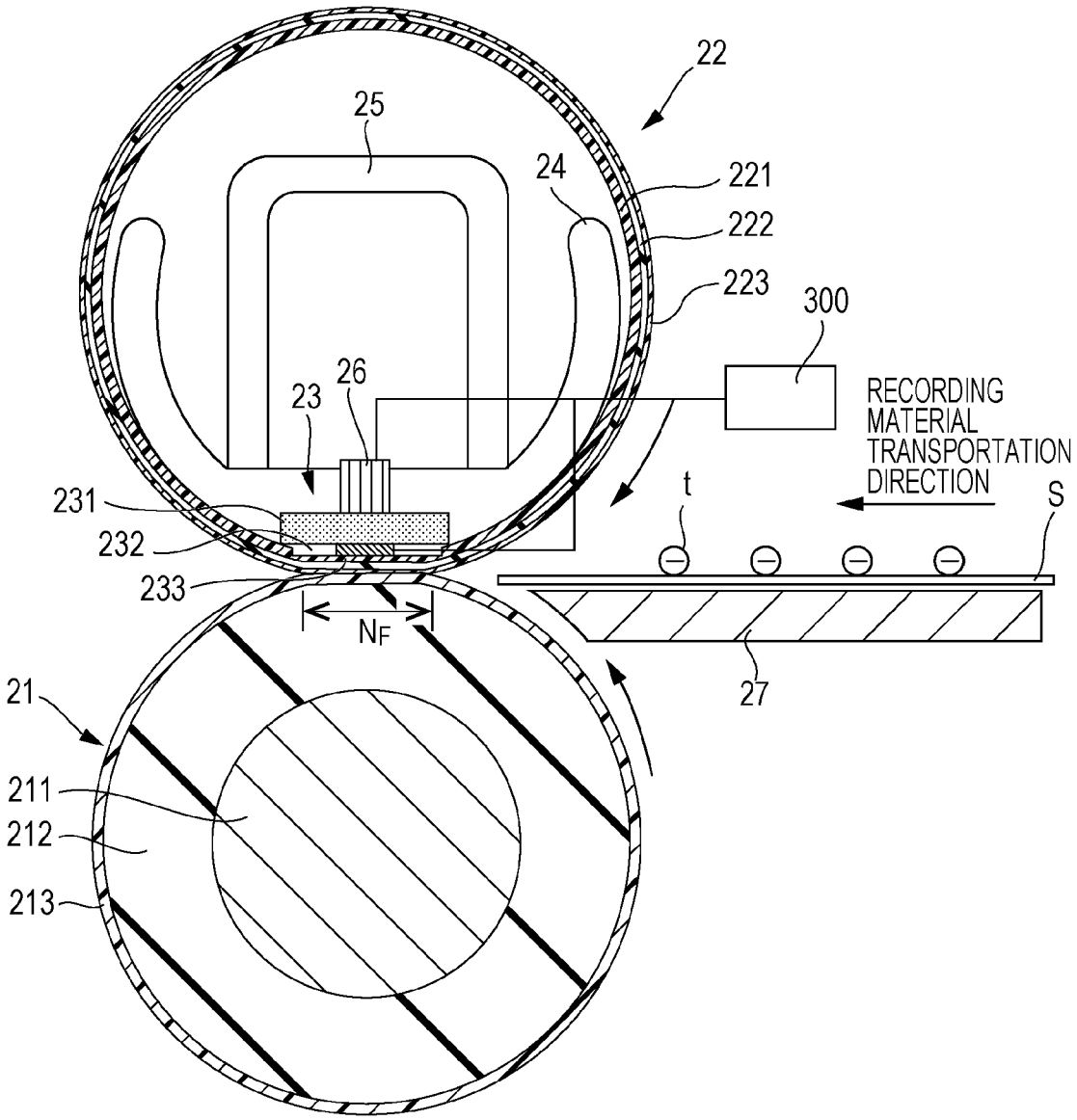
FIG. 2 is a diagram illustrating a configuration of a fixing apparatus according to the first embodiment.

FIG. 2 is a cross-sectional view of the fixing apparatus F1. The fixing apparatus F1 includes a cylindrical film 22, a heater 23 serving as a nip forming member which is in contact with the inner surface of the film 22, and a pressure roller 21 serving as a pressing member which forms a nip portion NF along with the heater 23. The fixing apparatus F1 further includes a heater holder 24 configured to hold the heater 23, and a reinforcing stay 25 serving as a reinforcing member configured to secure bending stiffness used for the fixing apparatus. Any of the pressure roller 21, film 22, heater 23, heater holder 24, and reinforcing stay 25 is a member longer in the longitudinal direction.

Also, this fixing apparatus F1 is a fixing apparatus configured to rotationally drive the pressure roller 21 using a driving source (not illustrated), thereby rotating the film 22 by being driven by the pressure roller 21.

The plate-shaped heater 23 includes a substrate 231 slender in the longitudinal direction, a heat generating resistor 233 formed on the substrate along the longitudinal direction, and an overcoat layer 232 configured to cover a heat generating resistor. The substrate 231 is made from ceramics. A connector (not illustrated) configured to supply power to a heat generating resistor is provided to both edge portions in the longitudinal direction of the substrate 231. The heater 23 is increased in temperature by a heat generating resistor to which power has been applied via the connector generating heat.

The heater holder 24 is a member of which the cross section having heat resistance and stiffness is formed in a generally semicircular conduit type. Liquid crystal polymer or the like is employed as the material of the heat holder 24. This heat holder 24 has a groove portion provided along the longitudinal direction in the center of the width direction of a face facing the heater 23, and the substrate 231 of the heater 23 is held by this groove portion to expose the overcoat layer 232 from the groove portion. With this heater holder 24, both edge portions in the longitudinal direction of the heat holder 24 are held by two side plates serving as apparatus frames (not illustrated).

The film 22 is a cylindrical member formed of a resin material having flexibility and heat resistance. The outer circumferential length of the film 22 according to the present embodiment is 57 mm. This film 22 includes a cylindrical base layer 221, an elastic layer 222 formed outside the base layer, and a releasing layer 223 outside the elastic layer 222. The base layer 221 is formed of polyimide with thickness of 50 microns, the elastic layer 222 is formed of a silicon rubber with thickness of 200 microns, and the releasing layer 223 is formed of a fluorine resin of 15 microns. The inner circumferential length of the film 22 is configured longer than the outer circumferential length of the heater holder 24 where the heater 23 is held by 3 mm. The film 22 thereof is loosely externally fitted to the heater holder 24 which holds the heater 23.

The reinforcing stay 24 is a member of which the cross section has a U-letter shape. This reinforcing stay 25 is disposed in the central portion in the transverse direction of a face on the opposite side of a face holding the heater 23 of the heater holder 24.

The pressure roller 21 includes a core metal 211, an elastic layer 212 of silicon rubber formed outside the core metal 211, and a releasing layer 213 of a fluorine resin having electroconductivity formed outside the elastic layer 212. The outer circumferential length of the pressure roller 21 is 63 mm. Note that the elastic layer 212 may be formed by foaming heat-resistance rubber such as fluorine-containing rubber or the like or silicon rubber or the like. The releasing layer 213 may be an insulating fluorine resin. The pressure roller 21 is disposed so as to be parallel to the film 22, and both edge portions in the longitudinal direction of the core metal 211 are held at side plates of the frame of the fixing apparatus via a bearing member in a rotatable manner. The core metal 211 of the pressure roller 21 and the reinforcing stay 25 are pressured so that the outer peripheral surface of the pressure roller 21 is in contact with the outer peripheral surface of the film 22 by a pressure spring (not illustrated) in both edge portions in the longitudinal direction. According to this pressure, the outer peripheral surface of the pressure roller 21, and the overcoat layer 232 of the heater 23 make up a nip portion NF with film predetermined width via the film 22. The total pressure is 20 kgf.

In response to the print signal, as illustrated in FIG. 2, the pressure roller 21 is rotated in a direction indicated by the arrow, at a predetermined circumferential velocity (process speed) 100 mm/sec. At this time, the film 22 is rotated by frictional force acts between the outer peripheral surface of the pressure roller 21 in the nip portion NF and the outer peripheral surface of the film 22. Therefore, at the time of the film 22 being rotated, the inner peripheral surface of the film 22 slides in a manner attached tightly to the heater 23. At this time, rotation of the film 22 is guided by the outer peripheral surface of the heater holder 24 formed along the inner peripheral surface of the film 22. Thus, rotation of the film 22 is stabilized, and the film 22 rotates following the same rotation path. Also, the control unit 300 starts power application to the heat generating resistor 233 of the heater 23 according to the print signal. In response to the power application to the heater 23 thereof, the heater 23 is increased in temperature and heats the film 22.

The temperature of the heater 23 is detected by a thermistor 26 serving as a temperature detecting element provided to a face on a side facing the heater holder 24 of the substrate 231. The control unit 300 controls power application to the heater 23 based on an output signal of the thermistor 26 so that the detected temperature of the thermistor 26 maintains predetermined target temperature T. Thus, the heater 23 is maintained at the target temperature. The target temperature T at the time of usual print is 120 to 230 degrees Centigrade. Upon rotations of the pressure roller 21 and film 22 being stabilized and the detected temperature of the thermistor 26 reaching the target temperature, the recording material S supporting the unfixed toner image passes through an entrance guide 27 and introduced to the nip portion NF. The recording material S thereof is conveyed by being sandwiched by the outer peripheral surface of the pressure roller 21 and the outer peripheral surface of the film 22 at the nip portion NF. At a conveying process thereof, heat and pressure are applied to the recording material S, and the unfixed toner image t is heated and fixed onto the surface of the recording material S. The recording material S on which the unfixed toner image t has been heated and fixed is separated from the surface of the film 22 by a curvature of the film and discharged from the nip portion NF.

(3) Image Processing Unit

Figure 3:
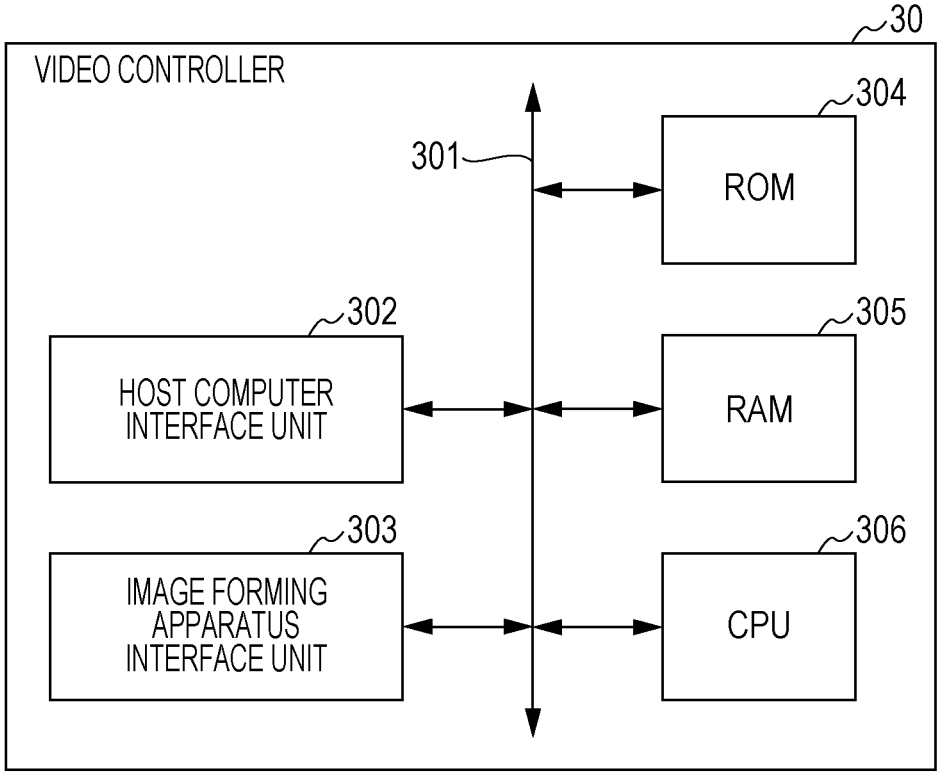
FIG. 3 is a diagram illustrating a configuration of a video controller according to the first embodiment.

The video controller 30 serving as an image processing unit will be described with reference to a diagram illustrated in FIG. 3. The video controller 30 includes various devices such as a host interface unit 302 mutually connected via a CPU bus 301, an interface unit 303, ROM 304, RAM 305, CPU 306, and so forth of the image forming apparatus. The CPU bus 301 includes an address, data, and a control bus.

The host interface unit 302 has a function to perform communication connection in two ways with a data transmission device such as a host computer or the like via a network. The interface unit 303 of the image forming apparatus has a function to perform communication connection with the image forming apparatus P in two ways.

The ROM 304 holds control program code for executing later-described image data processing, and other processing. The RAM 305 is memory to hold bitmap data and image density information which are results obtained by rendering image data received at the interface unit 303 of the image forming apparatus, and to hold a temporal buffer area and various processing statuses. The CPU 306 controls various devices connected to the CPU bus 301 based on the control program code held in the ROM 304.

(4) Image Data Processing and Detection of Image Density Information

Figure 4:
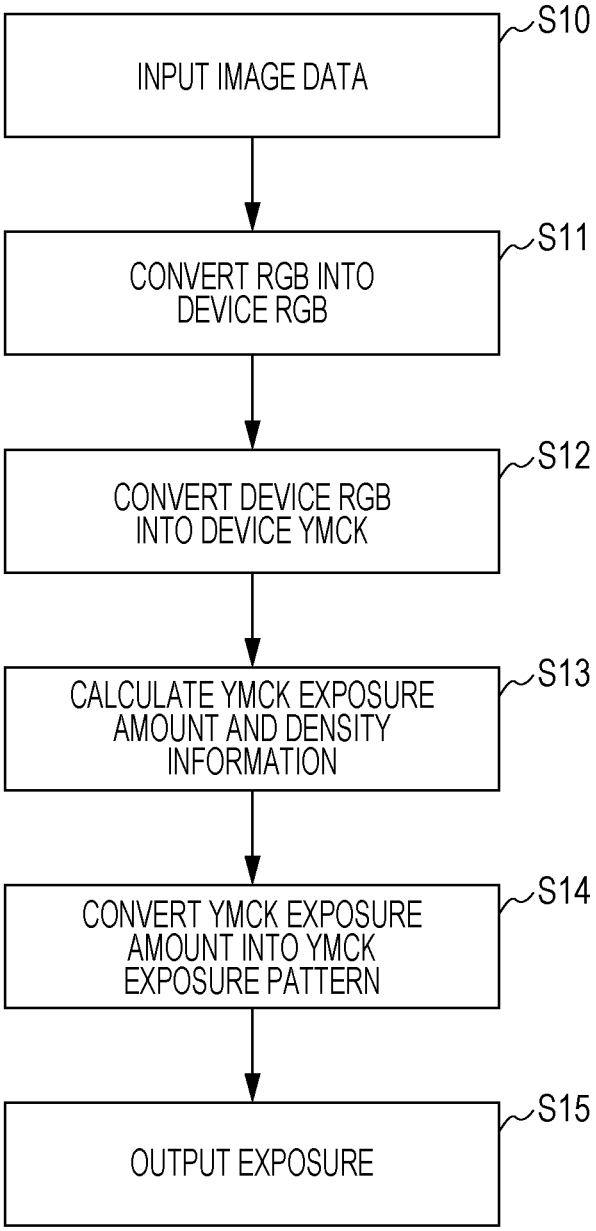
FIG. 4 is a diagram for describing an image data processing flow according to the first embodiment.

Image data processing will be described. FIG. 4 illustrates a image data processing flow. A command such as a paper size, an operation mode, or the like is transmitted from the host computer along with image data serving as image information (Processing S10). In the event that the image data relates to a color image, the image data has a format of color information according to RGB (Red, Green, Blue) data, each color information is assigned to device RGB data which is reproducible at the image forming apparatus and converted (processing S11). Next, the color information of the image data is converted from the device RGB data into device YMCK (Yellow, Magenta, Cyan, Black) data (processing S12).

The present YMCK data is defined as data representing a ratio of toner amount as to toner amount to be obtained on a transfer material in the event that all of lasers of image forming stations of the colors are turned on, and has width of 0% to 100% in monochrome. The data value 0% means that all of the lasers are turned off, and toner amount becomes 0.

Here, exposure amount of each color of YMCK is calculated as to the YMCK data using a tone table indicating a relation between exposure amount of each color and toner amount to be actually used. Also, at this time, the image density information D is simultaneously calculated (processing S13). For example, in the event that image data in a certain pixel is Y=50%, M=70%, C=20%, and K=0%, the image density information D becomes 140% (=50+70+20+0). Thereafter, exposure amount of each color is converted into an exposure pattern to be actually used as to each pixel (processing S14), and becomes exposure output (processing S15).

Note that, with the present embodiment, the image density information D is taken as the maximum density of the pixels within one page of the recording material S, and image density information of image data (first page) to be exposure-output at the nearest timing is stored in the RAM 305 as $D_1$. Further, image density information of image data (second page) to be exposure-output next is taken as $D_2$, and image density information of image data (n'th page) to be exposure-output thereafter is taken as $D_n$, and image density information from $D_1$ to $D_n$ is stored. Note that the detected time period of the image density information D may be changed depending on the size of image data or processing speed of the video controller 30, and accordingly, the number of image density information D stored in the RAM 305 is not necessarily constant.

(5) Image Density Information D and Toner Amount on Recording Material S

First, a relation between the image density information D and toner amount on the recording material S will be described. The image density information $D_n$ is density information of a pixel serving as the maximum exposure amount within the n'th image page. With the present embodiment, the minimum value of $D_n$ in full color is 0%, and the maximum density is set to 200% by taking fixing ability into consideration. $D_n$ is information having correlation with toner amount per unit area on the recording material S, toner amount per unit area on the recording material S at the time of $D_n$=100% is 0.45 to 0.50 mg/cm$^2$, and toner amount at the time of $D_n$=200% is 0.90 to 1.00 mg/cm$^2$. There are two principal reasons regarding why there is a range in toner amount on the recording material S. The first reason is that the entire toner of the photosensitive drum is unable to be transferred from on the photosensitive drum to the intermediate transfer belt 9 at the time of primary transfer. The second reason is that the entire toner on the intermediate transfer belt 9 is unable to be transferred from on the intermediate transfer belt 9 to the recording material S at the time of secondary transfer.

(6) Toner Amount on Recording Material S and Optimal Target Temperature

Next, a relation between toner amount on the recording material S and the fixation temperature T will be described. In the event of excessive heat quantity has been applied to predetermined amount of toner, hot offset may occur, and in the event that too small heat quantity has been applied, cold offset may occur. Accordingly, it is desirable to change the target temperature T of the heater 23 to an optimal value according to toner amount on the recording material S. The optimal target temperature mentioned here is the lowest temperature without occurrence of cold offset, which is a setting with the lowest power consumption. This optimal heater target temperature T can be found by confirming a fixing condition of toner on the recording material by changing toner amount on the recording material S and the target temperature of the heater 23. Note that the optimal target temperature T of the heater 23 differs depending on configurations and process speed.

Figure 5:
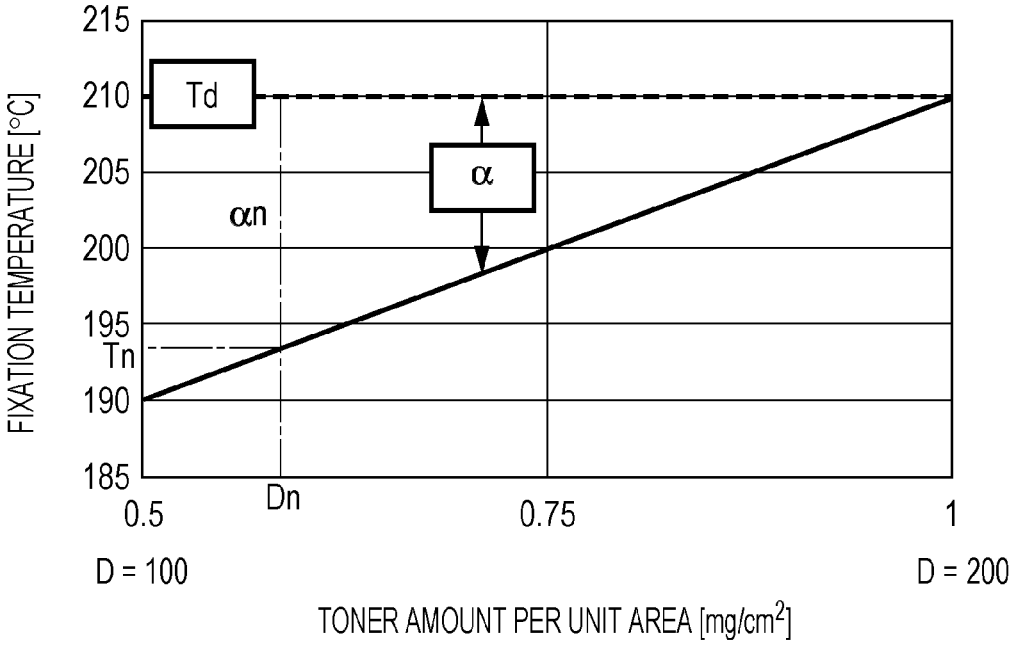
FIG. 5 is a diagram illustrating a relation between toner amount per unit area and fixation temperature according to the first embodiment.

FIG. 5 illustrates a diagram representing a relation between the toner amount on the recording material S and the optimal target temperature of the heater 23 in the present embodiment. The optimal target temperature of the heater 23 according to toner amount per unit area on the recording material S can be understood from FIG. 5. For example, the optimal temperature is 190 degrees Centigrade when toner amount is 0.5 mg/cm$^2$, 200 degrees Centigrade at the time of 0.75 mg/cm$^2$, and 210 degrees Centigrade at the time of 1.00 mg/cm$^2$. With the present embodiment, let us say that the target temperature of the heater 23 is 190 degrees Centigrade in the event that toner amount is smaller than 0.5 mg/cm$^2$. This is because there are many cases where monochrome black pixels are included in an even full color image, and in such cases, a portion where 0.5 mg/cm$^2$ (image density information D=100%) is included on the recording material S. Accordingly, even if there is rarely a case where toner amount is smaller than 0.5 mg/cm$^2$, this toner amount is handled as 0.5 mg/cm$^2$.

Figure 6:
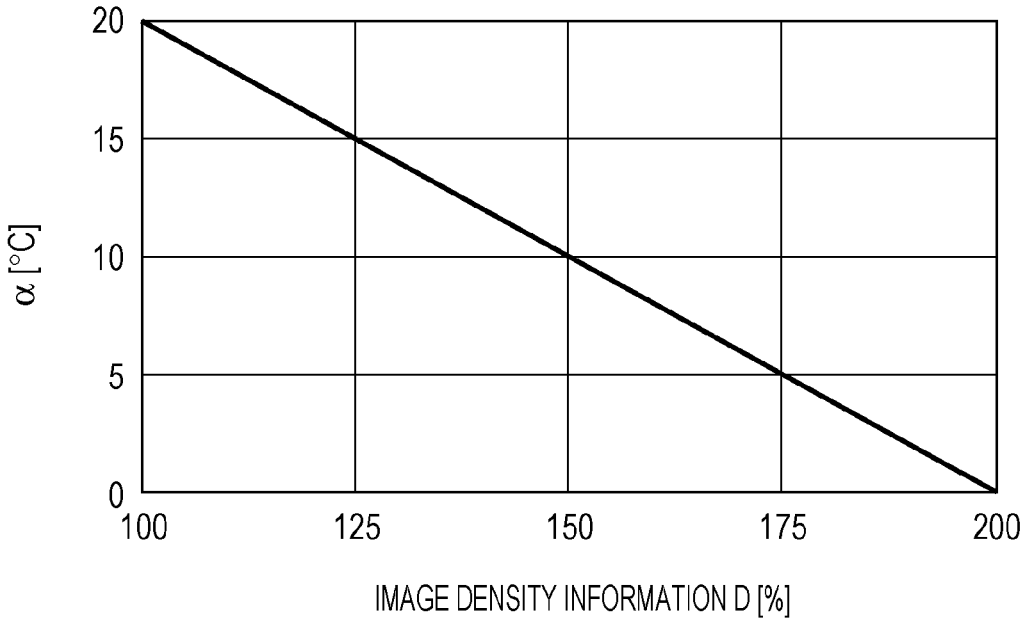
FIG. 6 is a diagram illustrating a relation between image density information and correction temperature of fixation temperature.

Here, reference target temperature $T_d$ is defined as the optimal reference fixation temperature in the upper limit density (1.00 mg/cm$^2$) of full color that is toner amount on the recording material S which can be set at the apparatus. Also, difference between $T_d$ and the optimal fixation temperature in optional toner amount is defined as corrected temperature α. As illustrated in FIG. 6, a becomes 20 degrees Centigrade at the time of D=100%, and is represented with a straight line such that a becomes 0 degree Centigrade at the time of D=200%. Accordingly, if we say that image density information of the n'th page is $D_n$, correction temperature $\alpha_n$ in the recording material of the n'th page is represented as follows.

$$\alpha_n=40-(0.2\times D_n)$$

From this relationship, there can be calculated the optimal target temperature $T_n$ of the heater 23 of the n'th page as illustrated in FIG. 5. A calculation expression is represented as follows.

$$T_n=T_d-\alpha_n=210-(40-(0.2\times D_n))(100\leq D_n\leq 200)$$

Note that, in the event that image density information is unobtainable, correction of the target temperature T is not performed. Specifically, this expression becomes as follows.

$$T_n=T_d$$

(7) Target Temperature Setting Method of Heater in Present Embodiment

First, description will be made regarding a case where the target temperature $T_n$ of the n'th page has been set from only the image density information $D_n$ of the n'th page as a first comparative example. In the event that the target temperature of the heater 23 of the n'th page has been set from $\alpha_n$ alone calculated from the image density information $D_n$ of the n'th page, an image defect such as cold offset or the like may occur at the leading edge of the (n+1)'th page. In particular, when difference at the target temperature of the heater 23 between pages to be consecutively printed is great, an image defect such as cold offset or the like readily occurs.

Figure 7:
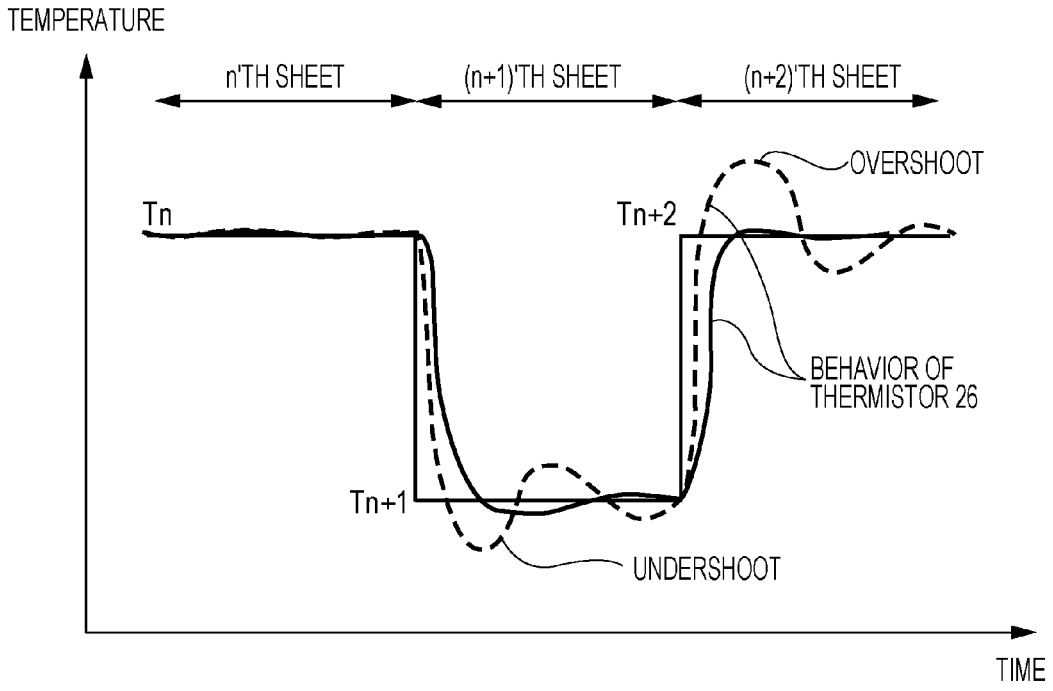
FIG. 7 is a diagram illustrating transitions of target temperature of a heater of a first comparative example and detected temperature of a thermistor.

The above problem will be described with reference to FIG. 7. FIG. 7 illustrates transition of detected temperature of the thermistor 26 at the time of consecutively printing n to (n+2) pages in the first comparative example. Let us say that density information of the n to (n+2) pages is $D_n$=200% ($T_n$=210 degrees Centigrade), $D_{n+1}$=150% ($T_{n+1}$=200 degrees Centigrade), and $D_{n+2}$=200% ($T_{n+2}$=210 degrees Centigrade). In FIG. 7, the target temperature T of the heater 23 is represented with a thin solid line, and transitions of detected temperature of the thermistor 26 in the event of the comparative example and a case of weakening control response in the comparative example are represented with a dotted line and a heavy solid line, respectively. With the comparative example, the target temperature T of the heater 23 was drastically changed over a short period of time, and accordingly, with the detected temperature of the thermistor 26, overshoot or undershoot occurred in the (n+1)'th page. A cause weakening the control response of the first comparative example represented with a heavy solid line can be suppressed regarding overshoot and undershoot, but response is poor and cold offset occurs at the leading edge of the (n+2)'th page.

In general, PI control is employed as power control of a heater in a fixing apparatus. In order to have a heated member quickly reach the target temperature, the P term can be increased. However, in the event of increasing the P term, convergence deteriorates, and hot offset or cold offset due to overshoot or undershoot of the temperature of the heater 23 readily occurs. On the other hand, in the event of decreasing the P term, response deteriorates, time necessary to reach the target temperature is prolonged, and an image defect such as hot offset or cold offset readily occurs.

In light of the above, we can say that when setting the target temperature $T_n$ of the heater 23 of the n'th page during consecutive printing according to the image density information $D_n$ alone, an image defect readily occurs.

In order to solve such a problem, with the present embodiment, the target temperature $T_n$ of the n'th page during consecutive printing is set according to the image density information $D_n$ of the recording material of the n'th page, and the image density information $D_{n+1}$ of the (n+1)'th page.

Now, let us consider a case of performing consecutive printing with a condition wherein the image density information $D_n$ of the n'th page, and the image density information $D_{n+1}$ of the (n+1)'th page differ. In the event that a relation between the image density information $D_{n+1}$ of the (n+1)'th page and the image density information $D_{n+2}$ of the (n+2)'th page is $D_{n+2}>D_{n+1}$, and a relation between the optimal target temperatures is $T_{n+2}>T_{n+1}$, cold offset readily occurs at the leading edge of the (n+2)'th page. In order to prevent this cold offset, let us consider the following.

In the event of determining the target temperature $T_n$ of the n'th page according to the image density information $D_n$ of the recording material of the n'th page, and the image density information $D_{n+1}$ of the (n+1)'th page, this is divided into the following two cases.

(1) Case of $D_{n+1}>D_n$

Cold offset is prevented by setting $T_n$ to the same as the target temperature $T_{n+1}$ necessary for the (n+1)'th page. $T_n$ after correction is represented as follows.

$$T_n=T_{n+1}=T_d-\alpha_{n+1}=210-(40-(0.2\times D_{n+1}))$$

(2) Case of $D_{n+1}\leq D_n$

Power consumption is reduced by setting $T_n$ to the same as the target temperature $T_n$ optimal for the n'th page. $T_n$ after correction is represented as follows.

$$T_n=T_d-\alpha_n=210-(40-(0.2\times D_n))$$

Figure 8:
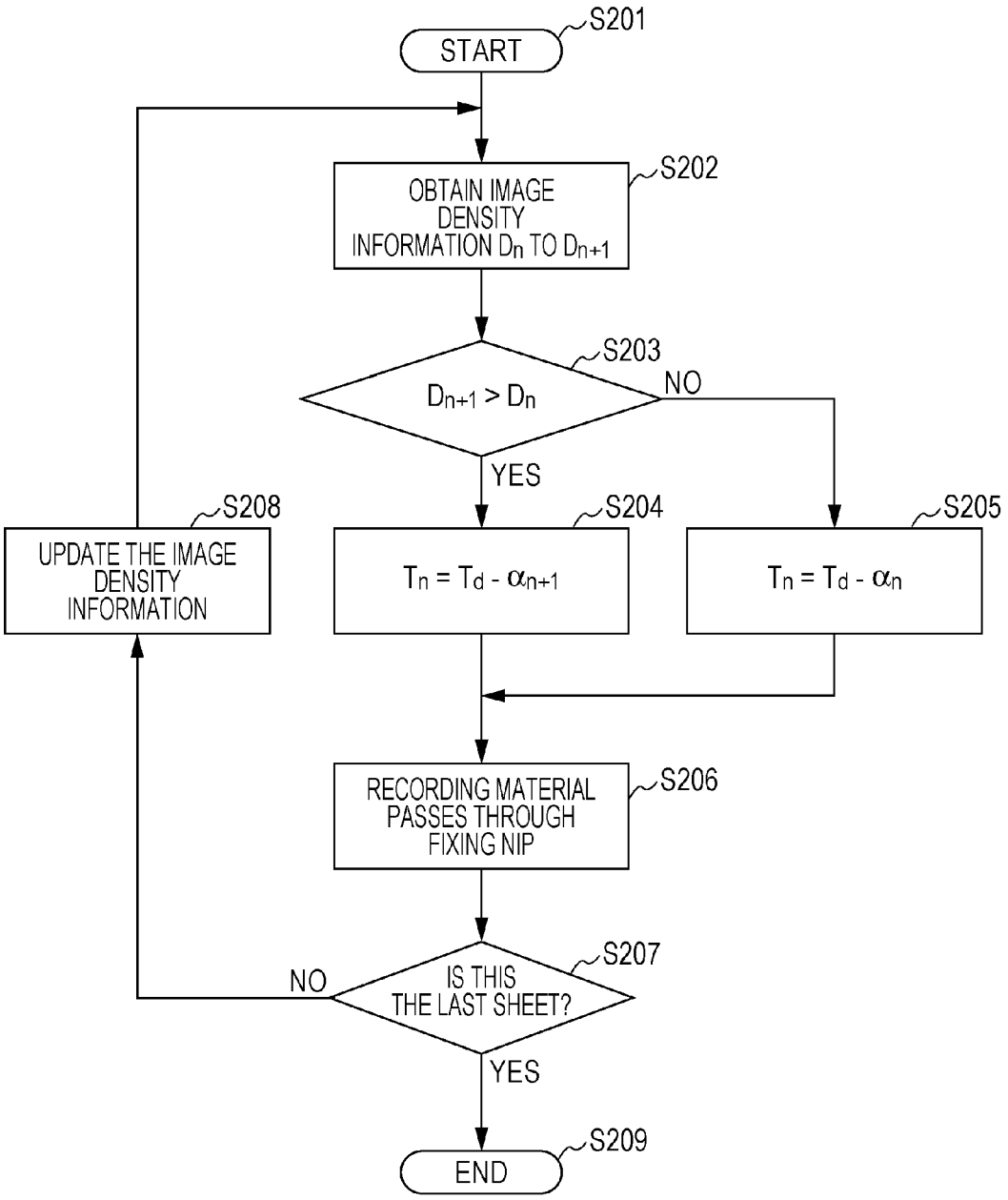
FIG. 8 is a diagram illustrating a flow of control for correcting fixation temperature according to the first embodiment.

An actual control flow is illustrated in FIG. 8. In S201, printing is started. In S202, the image density information $D_n$ and $D_{n+1}$ stored in the RAM 305 is obtained. In S203, $D_n$ and $D_{n+1}$ are compared regarding magnitude. When $D_{n+1}$ is greater, the flow proceeds to S204, and when $D_{n+1}$ is smaller, proceeds to S205. In S204, correction of the target temperature $T_n$ is performed according to $\alpha_{n+1}$. In S205, correction of the target temperature $T_n$ is performed according to $\alpha_n$. In S206, it is confirmed that the recording material S has passed through the nip portion NF. In S207, it is confirmed that there is a recording material to be continuously printed, and in the event that there is a recording material to be printed, the flow proceeds to S208, and in the event that there is no recording material to be printed, proceeds to S209, and printing is ended. In S209, updating of image density information to the latest image density information stored in the RAM 305 is performed. Specifically, the image density information $D_{n+1}$ obtained at the time of previously being printed becomes image density information $D_n$ in the latest information.

(8) Advantage Confirmation

Presence and absence of occurrence of cold offset at the time of performing continuous printing was confirmed between the first embodiment and the first comparative example. Let us consider a case where image density information $D_1$ to $D_6$ of six pages to be consecutively printed are $D_1$=200%, $D_2$=150%, $D_3$=150%, $D_4$=200%, $D_5$=100%, and $D_6$=200%, respectively.

The target temperature $T_n$ of the first comparative example is set according to only the image density information $D_n$ of the n'th page. The target temperature $T_n$ of the n'th page of the first comparative example is represented as follows.

$$T_n=T_d-\alpha_n=210-(40-(0.2\times D_n))$$

As a result thereof, cold offset occurred in the fourth and sixth pages. It is conceived that this is due to control being performed so as to satisfy $T_{n+1}>T_n$, and accordingly, the temperature of the thermistor 26 did not rise up to the target temperature T.

On the other hand, with the present embodiment, the target temperature $T_n$ of the n'th page is determined according to the image density information $D_n$ of the n'th page and the image density information $D_{n+1}$ of the (n+1)'th page. Specifically, the target temperature $T_n$ of the n'th page is set to temperature obtained by subtracting smaller one of the correction temperatures $\alpha_n$ and $\alpha_{n+1}$ from the reference target temperature $T_d$. With the first embodiment, it can be understood from Table 1 that power to be supplied to the heater can be reduced while suppressing cold offset.

TABLE 1

| | | CONTINUOUS SHEET PATTERNS | | | | | |
|---|---|---|---|---|---|---|---|
| | | 1ST | 2ND | 3RD | 4TH | 5TH | 6TH |
| IMAGE DENSITY INFORMATION $D_n$ | | 200% | 150% | 150% | 200% | 100% | 200% |
| | $\alpha_n$ | 0 | 10 | 10 | 0 | 20 | 0 |
| | $\alpha_{n+1}$ | 10 | 10 | 0 | 20 | 0 | — |
| PRESENT EMBODIMENT | TEMPERATURE CONTROL AFTER CORRECTION | 210 | 200 | 210 | 210 | 210 | 210 |
| | COLD OFFSET | ○ | ○ | ○ | ○ | ○ | ○ |
| FIRST COMPARATIVE EXAMPLE | TEMPERATURE CONTROL AFTER CORRECTION | 210 | 200 | 200 | 210 | 190 | 210 |
| | COLD OFFSET | ○ | ○ | ○ | X | ○ | X |

(9) Conclusion

The present embodiment has an advantage in that the target temperature $T_n$ of the n'th page during consecutive printing is set by taking not only the image density information $D_n$ of the n'th page but also the image density information $D_{n+1}$ of the (n+1)'th page into consideration, thereby enabling reduction of power consumption of the heater while suppressing occurrence of an image defect such as cold offset or the like in the (n+1)'th page.

Note that the target temperature $T_n$ of the n'th page may be decided using image density information of two or more pages. Specifically, the target temperature $T_n$ of the n'th page is set to temperature obtained by subtracting the lowest temperature of the correction temperatures $\alpha_n$ and $\alpha_{n+k}$ according to the image density information $D_n$ and $D_{n+k}$ of multiple pages (n to n+k) (k≥1) from the reference target temperature $T_d$. Alternatively, the target temperature $T_n$ of the n'th page may be set to the highest temperature of the target temperatures ($T_n$ to $T_{n+k}$) according to each image density information ($D_n$ to $D_{n+k}$) of the n to (n+k) pages without using the above correction temperatures.

Also, with the first embodiment, the target temperature of the n'th page in consecutive printing is lower in a case where the highest density of each image density information ($D_n$ to $D_{n+k}$) of the (n to (n+k)) pages is the first image density, as compared to a case where the highest density is the second image density.

Also, other temperature settings including the target temperature T described in the present embodiment are values to be changed depending on process speed, pressure, or other configurations, and accordingly are not restricted to the values in the present embodiment.

Second Embodiment (1) Configuration of Second Embodiment

The configuration of the image forming apparatus to which a second embodiment has been applied is the same as with the first embodiment, and components having the same or equivalent functions and configurations as with the first embodiment are denoted with the same reference numerals, and detailed description will be omitted.

With the second embodiment, let us consider a case where the process speed is faster than that of the first embodiment. The process speed in the present embodiment is 180 mm/sec. The faster the process speed, there is need to cover heat quantity necessary for fixing a toner image on a recording material, and accordingly, the target temperature of the heater 23 can be increased. With the second embodiment, in order to suppress occurrence of cold offset, the target temperature of the heater 23 can be set to 210 degrees Centigrade when toner amount on the recording material S is 0.5 mg/cm$^2$ (image density information D=100%), 220 degrees Centigrade at the time of 0.75 mg/cm$^2$ (image density information D=150%), or 230 degrees Centigrade at the time of 1.00 mg/cm$^2$ (image density information D=200%). Accordingly, the lowest temperature wherein a toner image of the highest density (D=200%) of full color that can be set at an apparatus of the present embodiment can be fixed and also no cold offset occurs is 230 degrees Centigrade, and accordingly, the reference target temperature $T_d$ becomes 230 degrees Centigrade.

Here, we investigated, in the event that the image density information $D_{n+1}$ of the (n+1)'th page is the highest density (200%), at what degree Centigrade of the target temperature of the heater 23 of the n'th page that cold offset occurs at the leading edge of the (n+1)'th page. As a result thereof, we found that cold offset occurs at the (n+1)'th page in the event the following expression is satisfied.

$$T_{n+1}-T_n>5^\circ\ \text{C.}$$

Figure 9:
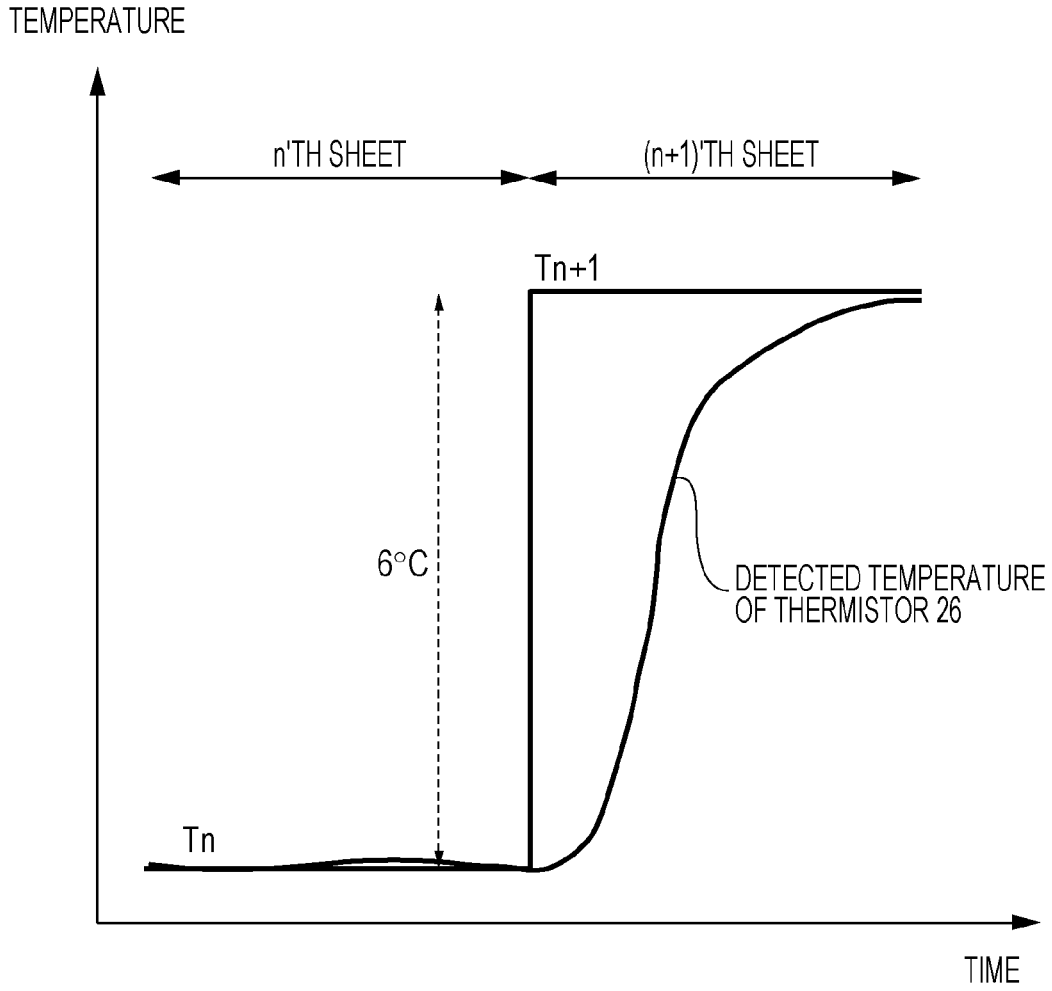
FIG. 9 is a diagram illustrating transitions of target temperature of a heater configured to generate cold offset and detected temperature of a thermistor.

FIG. 9 illustrates transition of detected temperature of the thermistor 26 regarding the n page to (n+1) page in the event that temperature difference between the target temperature $T_n$ of the n'th page and the target temperature $T_{n+1}$ of the (n+1)'th page during consecutive printing is six degrees Centigrade.

A thin solid line represents the set value of the target temperature T of the heater 23, and a heavy solid line represents transition of detected temperature of the thermistor 26. It is found from FIG. 9 that, in the event that temperature difference between the target temperature $T_n$ of the n'th page and the target temperature $T_{n+1}$ of the (n+1)'th page is six degrees Centigrade, the detected temperature of the thermistor 26 does not rise up to the target temperature $T_{n+1}$ at the (n+1)'th page. On the other hand, with the present embodiment, it was found that in the event that the temperature difference ($T_{n+1}-T_n$) of the target temperature of the heater 23 regarding the n page to (n+1) pages to be consecutively printed is five degrees Centigrade, no cold offset occurs.

That is to say, a condition wherein no cold offset occurs at the (n+1)'th page is as follows.

$$T_n\geq T_{n+1}-5^\circ\ \text{C.}$$

Similarly, a condition wherein no cold offset occurs at the (n+2)'th page is as follows.

$$T_n\geq T_{n+2}-2\times 5^\circ\ \text{C.}$$

For example, at the time of $T_{n+2}$=230 degrees Centigrade ($D_{n+2}$=200%), in the event that $T_n$ at the n'th page is equal to or higher than 220 degrees Centigrade, occurrence of cold offset can be suppressed at the (n+2)'th page.

According to the above relationship, in order to prevent cold offset form occurring at the (n+k)'th page, a condition wherein the target temperature $T_n$ of the n'th page has to satisfy is as follows.

$$T_n\geq T_{n+k}-k\times 5^\circ\ \text{C.}=T_d-(\alpha_{n+k}+k\times 5^\circ\ \text{C.})$$

k is a number indicating how many pages after the recording material of the n'th page that this recording material is fed.

Now, definition is made as follows.

$$\beta_k=\alpha_{n+k}+k\times 5^\circ\ C.$$

$\beta_k$ is correction temperature for correcting the target temperature $T_n$ of the n'th page in order to prevent cold offset from occurrence in a recording material to be fed after k pages from the recording material of the n'th page. Specifically, $\beta_1$ to $\beta_k$ are second correction temperatures obtained by weighting first correction temperatures $\alpha_{n+1}$ to $\alpha_{n+k}$ according to the image density information $D_{n+1}$ to $D_{n+k}$ with a page interval (the number of pages) from the n page of each page of the (n+1) to (n+k) pages. The second correction temperatures ($\beta_1$ to $\alpha_k$) are temperatures obtained by weighting the first correction temperatures ($\alpha_{n+1}$ to $\alpha_{n+k}$) according to each density information ($D_{n+1}$ to $D_{n+k}$) of the (n+1) to (n+k) pages so that the greater the page interval, the higher the temperature.

With the present embodiment, the target temperature $T_n$ of the n'th page during consecutive printing is the temperature obtained by subtracting the lowest temperature of the first correction temperature $\alpha_n$ according to the image density information $D_n$ of the n'th page and the second correction temperatures $\beta_1$ to $\beta_k$ from the reference target temperature $T_d$. Thus, there can be realized both of suppression of occurrence of cold offset from the n'th page to (n+k)'th page, and reduction of power consumption.

Note that the value of k is not constant, which is changed depending on whether or not image density information is obtained from the n'th page to which page is also changed according to size of image data, and the processing speed of the video controller 30.

Also, weighting according to a page interval as to the first correction temperatures ($\alpha_{n+1}$ to $\alpha_{n+k}$) according to each density information ($D_{n+1}$ to $D_{n+k}$) of the (n+1) to (n+k) pages is changed depending on process speed. This is because the upper limit of temperature difference of the target temperature of the heater 23 whereby cold offset can be suppressed from the n page to the (n+1) pages to be consecutively printed ($T_{n+1}-T_n$) decreases when process speed increases.

Figure 10:
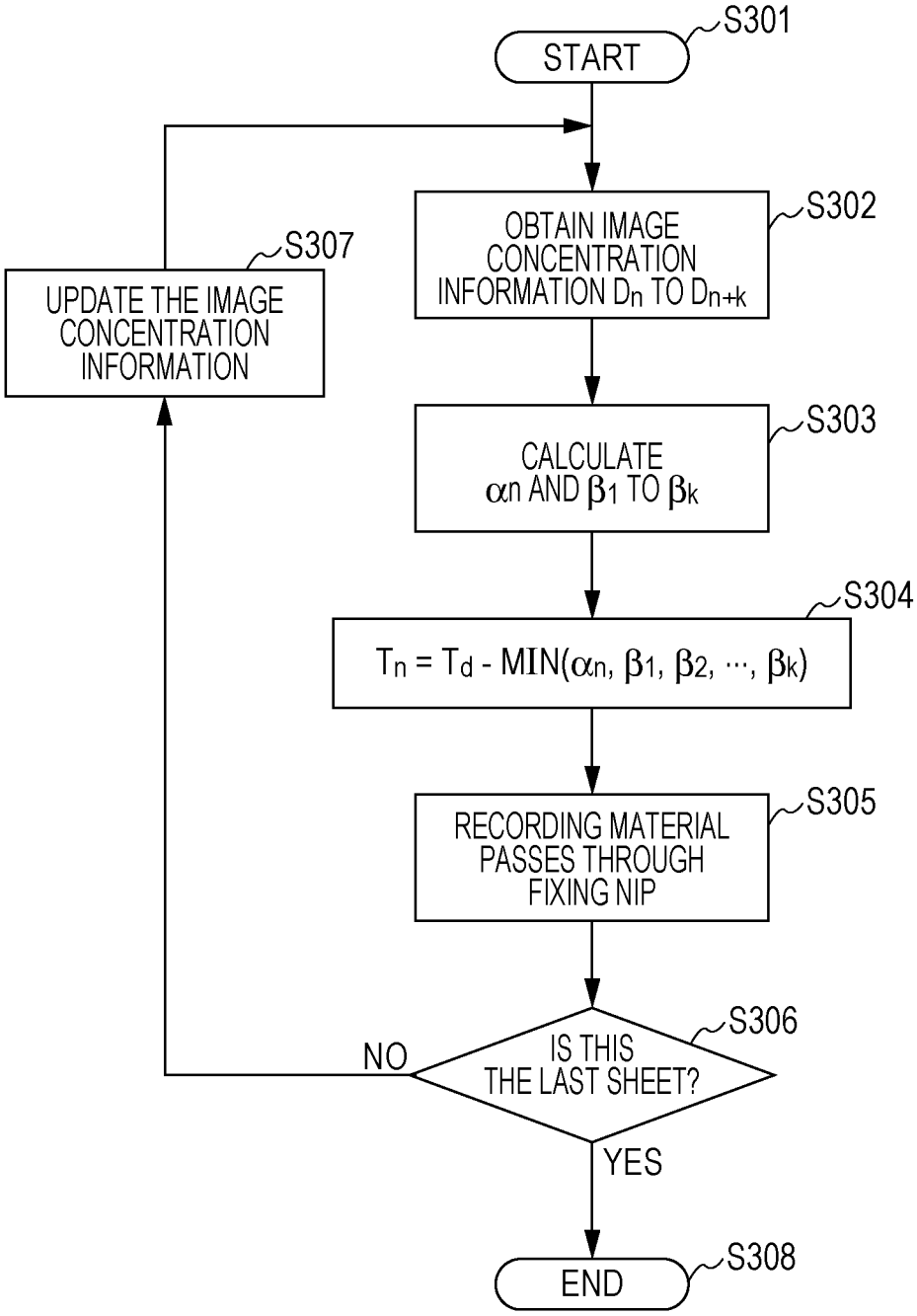
FIG. 10 is a diagram illustrating a flow of control for correcting fixation temperature according to a second embodiment.

Next, an actual control flow will be described with reference to FIG. 10. In S301, printing starts. In S302, a plurality of image density information $D_n$ to $D_{n+k}$ stored in the RAM 305 are obtained. In S303, based on the image density information, $\alpha_n$ and $\beta_1$ to $\beta_k$ are calculated in accordance with the above calculating method. In S304, of $\alpha_n$ and $\beta_1$ to $\beta_k$, the lowest correction temperature is used to perform correction of the target temperature $T_n$. In S305, confirmation is made that the recording material S passed through the nip portion NF. In S306, confirmation is made whether or not there is a recording material to be consecutively printed, and in the event that there is a recording material to be printed, the flow proceeds to S307, and if there is no recording material on which to print, in S308 printing is ended. In S307, updating of the image density information to the latest image density information stored in the RAM 305. Specifically, the image density information $D_{n+1}$ obtained at the time of previous printing becomes image density information $D_n$ in the latest information.

(2) Advantage Confirmation

In accordance with the above control flow, we performed an experiment for confirming an advantage by correcting the target temperature $T_n$. In order to simplify the experiment, the number of pages k whereby image density information can be obtained was constantly set to three pages. Table 2 illustrates confirmed results of presence and absence of occurrence of cold offset at the time of performing consecutive printing of nine pages with each of the present embodiment and a second comparative example.

The second comparative example is to correct the reference target temperature $T_d$ using only the correction temperature $\alpha_n$ according to the image density information $D_n$ of the n'th page, and the target temperature $T_n$ of the heater of the n'th page during consecutive printing is defined as follows.

$$T_n=T_d-\alpha_n=230-(40-(0.2\times D_n))$$

With the second comparative example, though reduction of power consumption is enabled, cold offset occurred at the 5'th and 6'th pages. It is conceived as a cause of this that the target temperature $T_n$ of the n'th page and target temperature $T_{n+1}$ of the (n+1)'th page to be consecutively printed do not satisfy $T_{n+1}-T_n\leq 5$ degrees Centigrade, and accordingly, the detected temperature of the thermistor 26 did not rise up to the target temperature T. $T_6-T_5$ and $T_7-T_6$ both indicate 10 degrees Centigrade.

On the other hand, with the present embodiment, the target temperature $T_n$ of the n'th page and target temperature $T_{n+1}$ of the (n+1)'th page to be consecutively printed constantly satisfy a relational expression of $T_{n+1}-T_n\leq 5$ degrees Centigrade, and accordingly, neither hot offset nor cold offset have not occurred at all.

TABLE 2

| | | CONTINUOUS SHEET PATTERNS | | | | | | | | |
|---|---|---|---|---|---|---|---|---|---|---|
| | | 1ST | 2ND | 3RD | 4TH | 5TH | 6TH | 7TH | 8TH | 9TH |
| IMAGE DENSITY INFORMATION | $D_n$ | 200% | 150% | 100% | 100% | 100% | 150% | 200% | 100% | 125% |
| | $\alpha_n$ | 0 | 10 | 20 | 20 | 20 | 10 | 0 | 20 | 15 |
| | $\beta_1$ | 15 | 25 | 25 | 25 | 15 | 5 | 25 | 20 | — |
| | $\beta_2$ | 30 | 30 | 30 | 20 | 10 | 30 | 25 | — | — |
| | $\beta_3$ | 35 | 35 | 25 | 15 | 35 | 30 | — | — | — |
| PRESENT EMBODIMENT | TEMPERATURE CONTROL AFTER CORRECTION | 230 | 220 | 210 | 215 | 220 | 225 | 230 | 210 | 215 |
| | COLD OFFSET | ○ | ○ | ○ | ○ | ○ | ○ | ○ | ○ | ○ |
| SECOND COMPARATIVE EXAMPLE | TEMPERATURE CONTROL AFTER CORRECTION | 230 | 220 | 210 | 210 | 210 | 220 | 230 | 210 | 215 |
| | COLD OFFSET | ○ | ○ | ○ | ○ | ○ | X | X | ○ | ○ |

(3) Conclusion

According to the above description, the target temperature $T_n$ of the n'th page during continuous printing according to the present embodiment becomes temperature obtained by subtracting the smallest value of the first correction temperature $\alpha_n$ according to the image density information $D_n$ of the n'th page and the second correction temperatures $\beta_1$ to $\alpha_k$ from the reference target temperature $T_d$.

With the present embodiment, regardless of process speed, there can be realized both of suppression of occurrence of cold offset from the n'th page to (n+k)'th page, and reduction of power consumption.

Note that the same operational effects are obtained even with the following method for setting the target temperature $T_n$ of the n'th page during continuous printing according to the present embodiment without employing the second correction temperatures β. This is a method for setting the target temperature of the n'th page to the highest temperature of the target temperature $T_n$ according to the density information $D_n$ of the n'th page, and the correction target temperatures ($T'_{n+1}$ to $T'_{n+k}$) obtained by correcting the target temperatures ($T_{n+1}$ to $T_{n+k}$) according to each density information ($D_{n+1}$ to $D_{n+k}$) of the (n+1) to (n+k) pages with a page interval (number of pages) from the n page of the pages ((n+1) to (n+k)), respectively.

Also, with the present embodiment, the optimal correction temperature is constantly selected without receiving influence of the size of image data, and processing speed of the video controller 30, nor influence of continuous sheet patterns.

Note that parameters such as the reference target temperature $T_d$, first correction amount α, second correction amount β, and so forth of the present embodiment are values to be changed depending on process speed, pressure of a nip portion of a fixing apparatus, and other configurations, and accordingly, are not restricted to the values in the present embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-264443, filed Dec. 3, 2012, which is hereby incorporated by reference herein in its entirety.

What is claimed is:

1. An image forming apparatus configured to form a toner image on a recording material, comprising:

an image forming unit configured to form an unfixed toner image on the recording material;

a fixing unit configured to heat the recording material where the unfixed toner image is formed while conveying the recording material at a nip portion, and to fix the unfixed toner image on the recording material; and a control unit configured to control power supplied to the fixing unit so that a temperature of the fixing unit is maintained at a target temperature, wherein the target temperature ($T_n$) of an n'th page in consecutive printing is set to the highest temperature of the target temperature ($T_n$) according to image density $D_n$ at the n'th page and corrected target temperatures ($T_{n+1}'$ to $T_{n+k}'$) obtained by correcting the target temperatures ($T_{n+1}$ to $T_{n+k}$) according to each of image densities ($D_{n+1}$ to $D_{n+k}$) at ((n+1) to (n+k))'th pages respectively, the corrected target temperatures ($T_{n+1}'$ to $T_{n+k}'$) corrected by subtracting a greater value from the target temperatures ($T_{n+1}$ to $T_{n+k}$) respectively as the number of pages of each of the target temperatures ($T_{n+1}$ to $T_{n+k}$) becomes greater, where integer k ≥1.

2. The apparatus according to claim 1, wherein the higher the image densities ($D_n$ to $D_{n+k}$), the higher the target temperatures ($T_n$ to $T_{n+k}$).

3. The apparatus according to claim 1, wherein the fixing unit includes a cylindrical film, a nip portion forming member configured to contact an inner surface of the film, and a pressing member configured to form the nip portion with the nip portion forming member through the film.

4. The apparatus according to claim 3, wherein the nip portion forming member is a heater.

5. An image forming apparatus configured to form a toner image on a recording material, comprising:

an image forming unit configured to form an unfixed toner image on the recording material;

a fixing unit configured to heat the recording material where the unfixed toner image is formed while conveying the recording material at a nip portion, and to fix the unfixed toner image on the recording material; and a control unit configured to control power supplied to the fixing unit so that a temperature of the fixing unit is maintained at a target temperature, wherein the target temperature of an n'th page in consecutive printing is set to the highest temperature of temperatures (n to n+k), and wherein the temperature (n) is a temperature ($T_n$) according to an image density($D_n$) at an n'th page, and the temperatures (n+1 to n+k) are obtained by correcting temperatures ($T_{n+1}$ to $T_{n+k}$) according to image densities ($D_{n+}$to $D_{n+k}$) at (n+1 to n+k)'th pages respectively, by subtracting the greater value from the temperatures ($T_{n+1}$ to $T_{n+k}$) respectively as the number of pages of each of the temperatures ($T_{n+1}$ to $T_{n+k}$) becomes greater, where integer k ≥1.

6. The apparatus according to claim 5, wherein the higher the image densities ($D_{n\ to\ Dn+k}$), the higher the temperatures ($T_n$ to $T_{n+k}$).

7. The apparatus according to claim 5, wherein the fixing unit includes a cylindrical film, a nip portion forming member configured to contact an inner surface of the film, and a pressing member configured to form the nip portion with the nip portion forming member through the film.

8. The apparatus according to claim 5, wherein the nip portion forming member is a heater.

9. An image forming apparatus configured to form a toner image on a recording material, comprising:

an image forming unit configured to form an unfixed toner image on the recording material;

a fixing unit configured to heat the recording material where the unfixed toner image is formed while conveying the recording material at a nip portion, and to fix the unfixed toner image on the recording material; and a control unit configured to control power supplied to the fixing unit so that a temperature of the fixing unit is maintained at a target temperature, wherein the target temperature of an n'th page in consecutive printing is set to the highest temperature of temperatures (n to n+k), and wherein the temperature (n) is a temperature ($T_n$) according to an image density($D_n$) at an n'th page, and the temperatures (n+1 to n+k) are obtained by correcting temperatures ($T_{n+1}$ to $T_{n+k}$) according to image densities ($D_{n+1}$ to $D_{n+k}$) at (n+1 to n+k)'th pages respectively, and by decreasing the temperatures ($T_{n+1}$ to $T_{n+k}$) in the greater decreasing width respectively as the number of pages of each of the temperatures ($T_{n+1}$ to $T_{n+k}$) becomes greater, where integer $k \geq 1$.

* * * * *